United States Patent [19]

Barton

[11] Patent Number: 4,917,626

[45] Date of Patent: Apr. 17, 1990

[54] CORD PLUG COUPLING

[76] Inventor: Paul S. Barton, R.F.D. 1, Box 2337, Liberty, Me. 04949

[21] Appl. No.: 404,273

[22] Filed: Sep. 7, 1989

[51] Int. Cl.[4] ..... H01R 13/639

[52] U.S. Cl. ..... 439/369; 439/371; 439/502

[58] Field of Search ..... 439/369–371, 439/502, 449, 451, 894

[56] References Cited

U.S. PATENT DOCUMENTS

| | | | |
|---|---|---|---|
| 4,440,465 | 4/1984 | Elliott et al. | 439/369 |
| 4,514,026 | 4/1985 | Herbert | 439/277 |
| 4,596,430 | 6/1986 | Olson | 439/369 |
| 4,690,476 | 9/1987 | Morgenrath | 439/369 X |

*Primary Examiner*—Steven C. Bishop

[57] ABSTRACT

Device for releasably holding together the male and female plugs of a power tool and an extension cord. A strap of interlocking "hook" material, e.g. Velcro® heavy-duty hook-type fastener, is adhered to either side of the male plug, the straps extending longitudinally past the face of the plug approximately two inches. A pad of interlocking "loop" material, e.g. Velcro® heavy-duty loop-type fastener, is adhered to either side of the female plug so as to face the straps when the plugs are engaged, whereupon the straps may be pressed into interlocking engagement with the pads. The thus engaged two plugs cannot easily be accidentally pulled apart, however, they are readily detached by the user when he wishes to disconnect them.

13 Claims, 1 Drawing Sheet

CORD PLUG COUPLING

This invention relates to devices for holding male and female electrical plugs together to prevent their being accidentally pulled apart.

BACKGROUND OF THE INVENTION

Electrical tools are manufactured with power-cords about six to eight feet (15 to 20 cm) long. Since the user generally moves about while using the tool and is often far from an electrical wall outlet, the tool is usually used in conjunction with an electrical extension cord.

Unless the tool-plug is fastened in some way to the extension cord plug, the plugs are easily and frequently pulled apart, thus disrupting power supply to the tool. This is very annoying, time consuming and may be dangerous.

Previously, various ways to hold these plugs together have been:

a. to wrap the plugs together with adhesive tape. This is effective but time consuming, difficult to connect, disconnect and reconnect the many times required or, as often happens, tape is not readily available;

b. to knot the cords loosely together. This is unreliable, damaging to the cords and the knot easily catches on any obstruction;

c. to employ rubber bands or string to tie the plugs together. This is generally time consuming and unsatisfactory;

d. a "patent pending" plastic device marketed by Colton Creations. This device is bulky, awkward to use and catches very easily on obstructions and easily fractures. It employs a pair of interfitting slides with cord-gripping slots at their remote ends. The cords are fitted into the slots and the slides slide toward each other. A ratchet-type lock holds them in place with the plugs engaged;

e. The use of "twist-lock" plugs. They are bulky, expensive and have only limited application because of their special construction and necessity of matching plugs. Such plugs are generally not provided on molded power or extension cords.

It is the object of this invention to provide a reliable, efficient and inexpensive device that is greatly needed in the building industry and in the home for holding together male and female electrical plugs, particularly the power cord of a tool to an extension cord.

SUMMARY OF THE INVENTION

In accordance with the invention there is provided a device for holding together a pair of mating electrical plugs which comprises at least one strap of fabric carrying a multiplicity of hooks on one face, the strap being devoid of hooks along a base area at one end, and being affixed by such base area to one side of a first one of the plugs with its hooked end extending beyond its end and with the hooks facing inwardly toward the plug to which it is fastened. A corresponding pad of fabric carrying a multiplicity of loops on only one side is affixed by its loopless side to the side of the second one of the plugs with its looped side facing outwardly toward the hooks of the strap. When the plugs are mutually engaged, the strap and the pad may be manually pressed together to lock the hooks and loops to each other. In preferred embodiments, there are provided a matching pair of straps and a matching pair of pads, one pair being affixed to one plug and the other pair being affixed to the other plug by means of rubber cement; the free end portion of each strap is pre-bent away from its plug to facilitate the insertion of one plug into the other; the straps are affixed to the male plug of the mating pair and the pads are affixed to the female plug, with the end of each strap scooped out to define ears which are provided with buttons to facilitate grasping by the user for releasing the straps from the pads and thereby permitting manual separation of the plugs from each other. The preferred looped and hooked fabric is Velcro®, preferably heavy duty which is a generally available suitable product.

The invention includes the provision of a kit comprising the necessary components for assembly with a mating pair of electrical plugs into a complete device, namely, a pair of straps of fabric carrying a multiplicity of hooks on one face, the straps being devoid of hooks along a base area at one end, each strap being adapted to be affixed by such base area to one side of a first one of the plugs with its hooked end extending freely beyond its end the hooks facing inwardly toward the plug to which it is fastened, a corresponding pair of pads of fabric carrying a multiplicity of loops on only one side adapted to be affixed by its loopless side to the side of the second one of the plugs with its looped side facing outwardly toward the hooks of the corresponding strap. The straps and pads are adapted to be affixed to the plugs by means of rubber cement. The preferred embodiments for the kit components are the same as above defined.

The following description and accompanying drawings will clarify and enhance the objects of this invention.

BRIEF DESCRIPTION OF THE DRAWINGS

The invention (in a preferred form) is shown full size on the drawings, the intention being that, at the time of manufacture, dimensions may change slightly or that a light-duty or extra-heavy-duty model be produced, but that the intent, character and form of the device remain essentially the same.

DETAILED DESCRIPTION OF A PREFERRED EMBODIMENT

Figure 1:
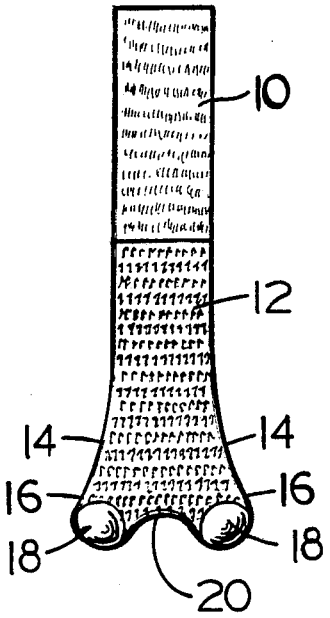
FIG. 1 is a face view of the "strap" member (of which two are required for optimum results)

FIG. 1 shows the "strap" member (two required) in face view, the material being Velcro® heavy-duty "hook." The reference numeral 10 indicates an area of approximately 1½" (3.8 cm) in length where the "hooks" have been omitted or removed. This area is to be adhered to the tool power-cord plug as described below. Some factory-pretreatment of this area may be desirable to enhance glue-bond. The Velcro® heavy-duty "hooks" on the strap are designated by the numeral 12, the strap being gradually flared as indicated at 14 to define finger-grip "ears" whose general shape and position are indicated at 16. This gradual flare improves the easing of the plugs past obstructions when the device is in use. These "ears" may be grasped by the user and pulled to release the "straps" from the "pads" when the user wishes to disconnect the plugs. A soft rubber (such as silicone rubber) knob or button 18 is formed on the "hook" side of each gripping "ear" so that the "ear" may be readily grasped with cold, wet or gloved fingers. The area between the "ears" may be scooped out at 20 to make the "ears" more pronounced and thus easier to grasp.

Figure 2:
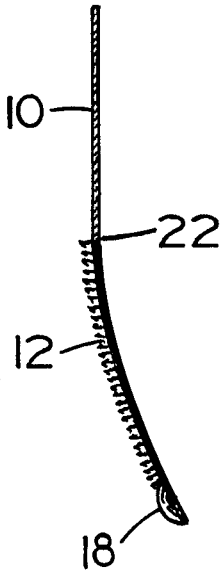
FIG. 2 is a side view of the "strap" member as shown in FIG. 1.

FIG. 2 shows a side view of the "strap" member as shown in FIG. 1, like numerals referring to like parts in this and the remaining views. In this view the numeral 22 indicates an arching or bending back of the "strap" to facilitate entry of the tool plug into the extension cord plug. It would also facilitate entry into a wall receptacle. This detail is not necessary but would be desirable in a preferred embodiment and it can be accomplished easily without making the straps too stiff.

Figure 3:
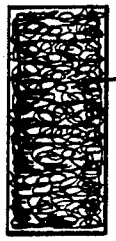
FIG. 3 is a face view of the "pad" member (of which two are required)
Figure 4:
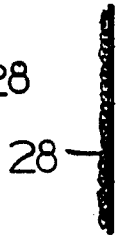
FIG. 4 is a side view of the "pad" member as shown in FIG. 3.

FIG. 3 shows a face view and FIG. 4 a side view of one of the two "pad" members. In this view, the numeral 28 designates the Velcro® heavy-duty "loop" material to match the "hook" material of the "straps." The back of this "pad" (the smooth side) may be factory treated to improve its surface characteristics and is adapted to be cemented to the extension cord female plug.

Figure 5:
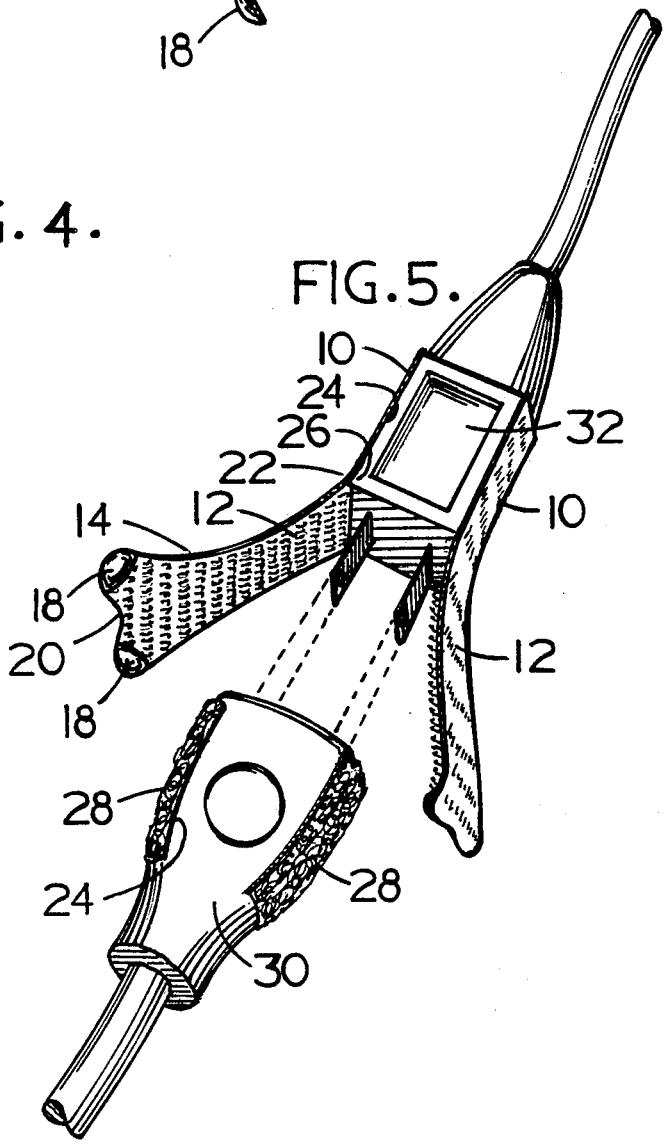
FIG. 5 is a perspective view of the complete device (two "straps" and two "pads") attached to their respective plugs and illustrating the mode of attachment.

Referring now to the perspective view of FIG. 5, the tool power cord plug 32 and the female extension cord plug 30 can be seen with the complete device (two "straps" and two "pads") fixed in place thereon and ready to be connected. The smooth (no hooks) area 10 of the "straps" are cemented by high-quality rubber cement 24 to the prepared surface of the plug 32. The numeral 26 indicates a location on the plug 32 where, as on many plugs, a small projection may need to be trimmed off before cementing the "straps." In this preferred embodiment the optional bend or arch 22 in the "strap" is shown. It facilitates clearance when plug ging the cords together. When the plugs are engaged and the Velcro® pieces mutually secured, the gradual flare 14 functions to facilitate non-snagging of the plugs. The rubber knob grips 18 (formed on the "hook" faces of the "ears") extend loosely beyond the remote ends of the Velcro® "pads" 28 of "loop" material on the plug 30 so that the "ears" may be more easily grasped under adverse conditions. The "pads" can be trimmed with scissors to proper size to fit the plug and adhered thereto, as indicated, by high-quality rubber contact cement (or equivalent cement) in the same manner as the "straps" are adhered to the male plug.

The two "straps" of the device, made of Velcro® heavyduty hook material, are about ⅝" (1.6 cm) wide at the narrow end and about 1⅛" (2.85 cm) wide at the other end, with an overall length of about 4½" (11.4 cm). As already mentioned, each "strap" is gradually flared out toward the wide end to prevent snagging when in use and o provide finger tabs or ears for easy unlocking. Each ear,in turn, carries a soft rubber or plastic knob to provide finger grips for easy use with or without gloves. The recess 20 between the ends of the ears gives emphasis to the ears, making them more prominent and more easily gripped between the fingers.

As stated above, each "strap" at its narrow end is devoid of hooks for a distance of about 1½" (3.8 cm) to define a relatively smooth area suitable for the application of the adhesive. It is recommended that this area be especially primed to enhance the bond of the cement whose quality is crucial to the performance of the invention. It must possess "fast grab," high strength, flexibility in all weather, weather resistance and compatibility with electrical cord plug materials. A number of suitable cements are readily available in the market place.

The "straps" are attached to the tool plug on opposite sides of the plug and facing the flats of the prongs. The hooks of the Velcro® face inwardly toward each other. It is intended that these "straps" be factory treated so that they inherently bend outwardly away from each other to facilitate insertion of the male plug into the extension cord plug or a wall outlet. The two Velcro® "loop" "pads" approximately ½"(1.6 cm) wide by 1½" (3.8 cm) long desirably have been factory primed to enhance the bond of the adhesive when cemented to the plug. The pads are cemented to the female plug of the electrical extension cord in a manner similar to that of the straps to the tool cord and in a position to receive the straps.

The adhered portions of the straps and pads may need trimming with scissors if the plugs are not large enough to accept their full 1½" (3.8 cm) length.

Some plugs have ridges or projections where the straps or pads will be adhered. These must be trimmed with a sharp knife or file before cementing begins.

Use of the Device

To use this device one bends the straps outwardly and inserts the tool plug into the extension cord plug, then smooths the straps down onto the pads. A light press between thumb and finger on the straps over the pad area completes the connection.

To disconnect, one grips an ear on one strap and peels back the strap, then the same is done on the second strap. The plugs are then free to disengage.

The Velcro®"hook and loop" material is electrically nonconductive and is not seriously affected by hot or cold weather or rain or snow. Mud easily shakes free.

When this device is in use, it tends to conform to the plug shapes and that tends to streamline the plugs so that they ride more easily over projections or through weeds and long grass.

The present invention is intended to be marketed in "kit" form and to be installed by the user. But, it is quite possible that the device may also be factory-installed by the cord or tool manufacturer. The kit should consist of two straps, two pads, the necessary adhesive and appropriate instructions.

Advantages of the Present Invention

The present invention is designed to and does overcome the disadvantages of all the aforementioned known methods by providing a very reliable, simple, quick, easy-to-use, inexpensive and durable means for securing an electric tool power cord plug to an extension cord plug.

Once the "straps" and "pads" have been initially installed (which takes about fifteen or twenty minutes and no special skills), the plugs, so modified, can be locked together in about two seconds and may be disconnected in less time.

In case of damage to the device, it may be easily removed from the plugs without damaging them and a new device (kit) applied with very little preparation.

The plugs so outfitted with this device may be used without inconvenience in any unmodified plug or standard wall outlet.

While this device, when in use, may be pulled apart by a direct and forceful pulling apart of the plugs, this does not occur under normal circumstances. The device, of course, is not intended to restrain a tool from falling if the tool is dropped or knocked from a scaffold so as to be hanging by the cord.

While there is herein disclosed and described a presently preferred embodiment of the invention, it will nevertheless be understood that the same is suscepitble of modification and change by those skilled in the art and that the disclosure is by way of illustration and not be way of limitation. It is intended that the scope of the invention be limited only by the proper interpretation to be accorded the accompanying claims.

I claim:

1. Device for holding together a pair of mating electrical plugs which comprises at least one strap of fabric carrying a multiplicity of hooks on one face, the strap being devoid of hooks along a base area at one end, said strap being affixed by such base area to one side of a first one of said plugs with its hooked end extending beyond its end the hooks facing inwardly toward the plug to which it is fastened, a corresponding pad of fabric carrying a multiplicity of loops on only one side, said pad being affixed by its loopless side to the side of the second one of said plugs with its looped side facing outwardly toward the hooks of the strap, whereby when said plugs are mutually engaged said strap and said pad may be manually pressed together to lock said hooks and loops to each other.

2. The device of claim 1 having a matching pair of straps and a matching pair of pads, one pair being affixed to one plug and the other pair being affixed to the other plug.

3. The device of claim 2 wherein said straps and pads are affixed to their respective plugs by means of rubber cement.

4. The device of claim 2 wherein the free end portion of each strap is pre-bent away from its plug to facilitate the insertion of one plug into the other.

5. The device of claim 2 wherein the straps are affixed to the male plug of the mating pair and the pads are affixed to the female plug of said pair.

6. The device of claim 5 wherein the end of each strap is scooped out to define ears for grasping by the user for releasing the straps from the pads and thereby permitting manual separation of the plugs from each other.

7. The device of claim 6 wherein said ears are provided with buttons to facilitate grasping thereof by the user.

8. Device in kit form for holding together a pair of mating electrical plugs which comprises a pair of straps of fabric carrying a multiplicity of hooks on one face, the strap being devoid of hooks along a base area at one end, each said strap being adapted to be affixed by such base area to one side of a first one of said plugs with its hooked end extending freely beyond its end the hooks facing inwardly toward the plug to which it is fastened, a corresponding pair of pads of fabric carrying a multiplicity of loops on only one side, each said pad being adapted to be affixed by its loopless side to the side of the second one of said plugs with its looped side facing outwardly toward the hooks of the corresponding strap, whereby when said plugs are mutually engaged said straps and said pads may be manually pressed together to lock said hooks and loops to each other thereby locking said plugs to each other.

9. The device of claim 8 wherein said straps and pads are affixed to their respective plugs by means of rubber cement.

10. The device of claim 8 wherein the free end portion of each strap is pre-bent away from its plug so as to facilitate the insertion of one plug into the other when the straps are affixed thereto.

11. The device of claim 10 wherein the straps are adapted to be affixed to the male plug of the mating pair and the pads are adapted to be affixed to the female plug of said pair.

12. The device of claim 11 wherein the end of each strap is scooped out to define ears for grasping by the user for releasing the straps from the pads and thereby permitting manual separation of the plugs from each other.

13. The device of claim 12 wherein said ears are provided with buttons to facilitate grasping thereof by the user.

* * * * *

UNITED STATES PATENT AND TRADEMARK OFFICE

CERTIFICATE OF CORRECTION

PATENT NO. : 4,917,626

DATED : April 17, 1990

INVENTOR(S) : Paul S. Barton

It is certified that error appears in the above-identified patent and that said Letters Patent is hereby corrected as shown below:

Col. 3 line 38, "plug ging" should be -- plugging --;

Col. 3 line 57, "o" should be -- to --;

Col. 4 line 13, "1/2"" should be -- 5/8" --

Signed and Sealed this

Twenty-eighth Day of May, 1991

*Attest:*

HARRY F. MANBECK, JR.

*Attesting Officer*

*Commissioner of Patents and Trademarks*